US005181413A

United States Patent [19]

LaBounty

[11] Patent Number: 5,181,413

[45] Date of Patent: Jan. 26, 1993

[54] PIPE COLLAPSING ATTACHMENT

[75] Inventor: Roy E. LaBounty, Two Harbors, Minn.

[73] Assignee: LaBounty Manufacturing, Inc., Two Harbors, Minn.

[21] Appl. No.: 685,477

[22] Filed: Apr. 12, 1991

[51] Int. Cl.[5] ..... B21D 7/06

[52] U.S. Cl. ..... 72/416; 72/407; 72/453.02; 72/453.15; 29/890.14; 29/727; 251/7

[58] Field of Search ..... 72/416, 412, 407, 402, 72/453.02, 453.15, 367, 293; 29/727, 283.5, 282, 890.14, 237; 251/5, 7

[56] References Cited

U.S. PATENT DOCUMENTS

| | | | |
|---|---|---|---|
| 1,497,398 | 6/1924 | Axelson | 72/407 |
| 2,182,663 | 12/1939 | Eby | 72/402 |
| 3,086,797 | 4/1963 | Webb | 251/7 |
| 3,252,474 | 5/1966 | Ehrens | 72/294 |
| 3,419,008 | 12/1968 | Plishner | 251/7 |
| 3,511,469 | 5/1970 | Bell | 251/7 |
| 3,822,456 | 7/1974 | Petruzzi | 72/402 |
| 3,937,050 | 2/1976 | Nicholson | 72/416 |
| 4,231,246 | 11/1980 | Gorenc | 29/727 |
| 5,007,280 | 4/1991 | Quinn | 72/416 |

*Primary Examiner*—Daniel C. Crane
*Attorney, Agent, or Firm*—Palmatier & Sjoquist

[57] ABSTRACT

An apparatus for collapsing and crushing heavy-duty steel well casings and similar pipes to terminate flow of liquids such as crude oil therethrough, a housing portion gripping and sealing spaced portions of the casing, casing collapsing rams at opposite sides of the casing and between said portions of the housing and confined within portions of the housing; and a pair of hydraulic cylinders driving the rams inwardly against the casing to collapse it and crush it to reduce and substantially prevent flow of liquid or crude oil through the casing.

8 Claims, 2 Drawing Sheets

PIPE COLLAPSING ATTACHMENT

This invention relates to apparatus for collapsing heavy-duty pipes of steel and the like for the purpose of terminating fluid flow through the pipe which may otherwise be uncontrolled.

BACKGROUND OF THE INVENTION

Heavy-duty pipes and casings may in some instances carry the flow of liquids under pressure in a situation wherein there may be no control on the flow of the liquids through the pipe. This situation may exist where control devices such as valves have been severely damaged, or the control devices may be so remote as to be inoperable. If the pipe which has been damaged is a part of a network, isolating and shutting down the flow in a particular section of pipe may be near impossible.

A typical situation where flow of liquid is not controllable is in an oil well situation wherein the valving for the well casing is completely damaged or gone and flow of crude oil is induced by natural fluid pressures originating deep in the oil bearing strata, many hundreds of feet below surface level. This situation has been found to exist as in the oil fields of Kuwait wherein the control valving and other apparatus has been completely destroyed and crude oil flows under high pressure through the well casings and is spewing into the atmosphere above ground level.

SUMMARY OF THE INVENTION

An object of the invention is to provide an apparatus for collapsing a heavy-duty pipe or casing in order to terminate the flow of liquid through the casing, which flow is otherwise uncontrollable.

A feature of the invention is a device attachable in near sealing relationship onto the exterior of the pipe and having a pair of rams, operated by hydraulic cylinders, which are to be driven against opposite sides of the steel casing to deform and collapse the casing and close the interior of the casing as to obstruct flow through the casing.

Another feature of the invention is a two-part clamping head which is in two parts, bolted together, and tightly gripping the casing above and below the location at which the rams collapse the pipe. The tight gripping of the pipe minimizes leakage of liquid from the ruptures in the pipe which are caused by the collapsing rams; and the tight gripping by the two-part head onto the pipe also maintains the shape of the pipe and minimizes the likelihood of extension of ruptures along the casing.

Although it is expected that with pressures encountered in an oil well situation, there may be substantial leakage, as up to 30% of the previous flow through the casing, the leakage can be substantially reduced to 5% to 10% of the previous flow as to permit further work on the heavy-duty casing to complete the repair.

DETAILED SPECIFICATION

Figure 1:
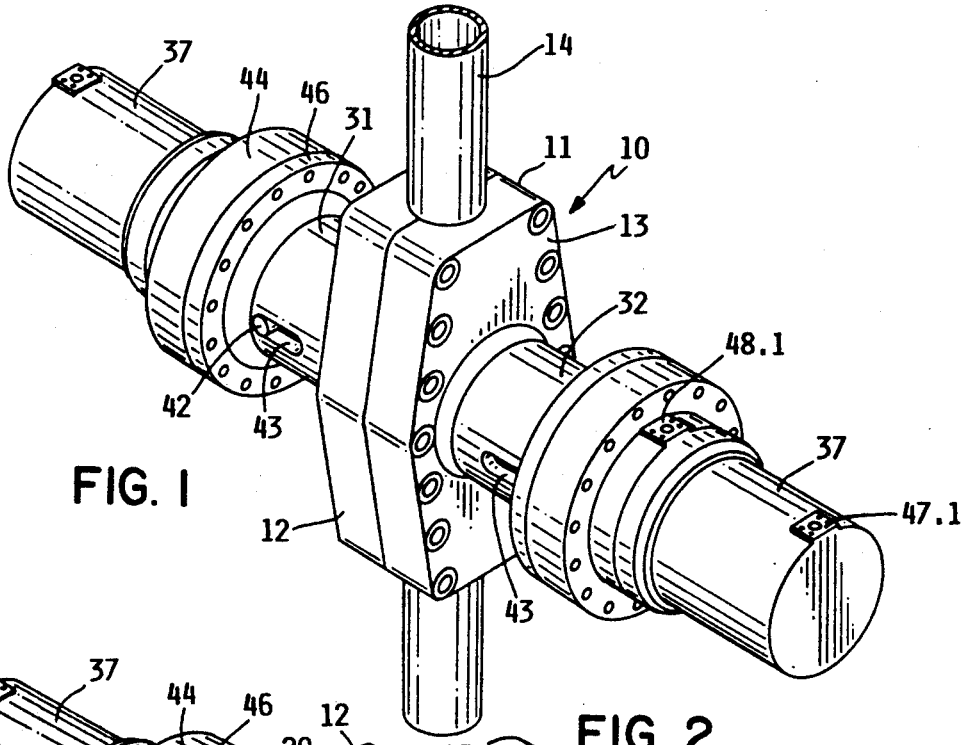
FIG. 1 is a perspective view of the apparatus shown attached to a heavy-duty well casing or pipe.

One form of the invention is illustrated and described herein. The pipe collapsing apparatus is indicated in general by numeral 10. The pipe collapsing apparatus includes a steel body or head portion 11 which is in two parts 12 and 13 for clamping and embracing a length of heavy-duty steel casing or pipe 14 which is to be transversely collapsed or crushed. Such casings 14 may be of the type used in oil wells, and may vary widely in diameter, depending upon the design of the well. In one instance the shell casing 14 may have an approximate outside diameter of seven inches, and the casing wall may be approximately 0.52 to 0.56 inches in thickness. In other casings, the sizes may range to four inches to six inches in outside diameter, and in some cases may be substantially larger than seven inches. The casing 14 in an oil well is typically the innermost of a multiplicity of concentric casings which may number from five to nine in various wells. The voids between the casings may be filled with concrete, and of course, the outer casings and the concrete fillings must be stripped away in order to apply the apparatus 10 onto the innermost casings which carries the crude oil from the oil bearing strata in the earth.

The elongate steel shell halves 12 and 13 comprising the two parts of the head portion 11 have flat facing surfaces 15 bearing and sealing against each other, and suitable sealing gasket material may be interposed between the facing gasket surfaces. The shell portions 12 and 13 have a multiplicity of bolt holes 16 therethrough for a multiplicity of clamping bolts 17 which hold the shell halves 12 and 13 together so that the facing surfaces 15 bear against each other and produce a sealing relationship.

Figure 4:
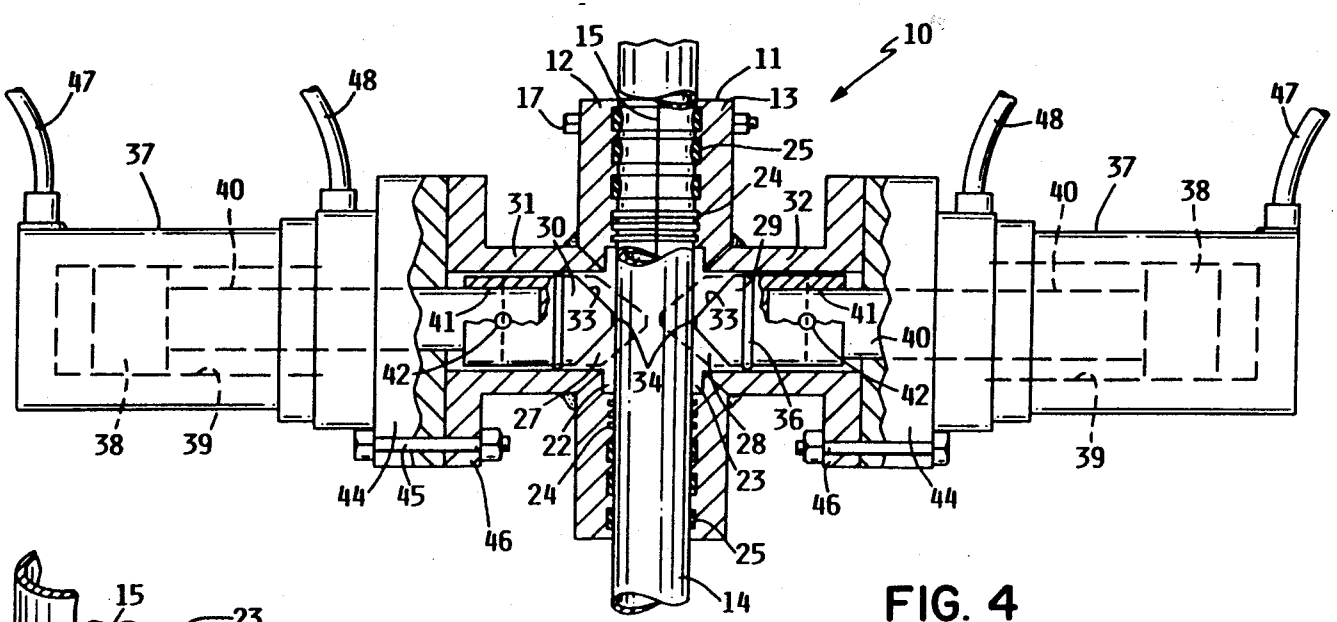
FIG. 4 is an elevation view of the apparatus, broken away and shown partly in section for clarity of detail.

Each of the shell halves 12 and 13 have end portions 18 and 19, and grooved semicircular gripping faces 20 and 21 to tightly grip and seal against the outside surface of the casing 14 which extends through the housing portion as illustrated in FIGS. 1 and 4. Each of the shell halves 12 and 13 also define an enlarged interior chamber portion 22 and 23. The casing gripping surfaces 20 and 21 each have three sharp edged grooves 24 adjacent the interior chamber portions 22, 23; and the gripping surfaces 20, 21 of the shell halves 12, 13 will bite into the outside surface of the casing 14 at each of the grooves 24 as to very tightly grip and seal against the casing 14. The upper and lower semicircular casing gripping surfaces 20, 21 also have three large grooves 25 adjacent the terminal upper and lower ends of the shell halves 12, 13, and these grooves 25 contain gasket or packing material which will tightly seal against the outer surface of the casing 14 when the head portion is tightened onto the casing. The gasket material 26 may be any of a number of types of gasket such as rubber, lead, oakum, steel, and other similar materials. The gasket material 26 in the grooves 25 is semicircular in shape to conform to the shape of the grooves and when the head portion 11 is tightly clamped onto the casing 14, the gaskets 26 will entirely surround and embrace and seal against the casing as to prevent or minimize any movement of fluid such as crude oil along the casing.

Each of the shell halves 12, 13 has a transverse opening 27, 28 intermediate the ends, and the casing collapsing rams 29, 30 obtain access into the interior chambers 22, 23 through the openings 27, 28. The shell halves 12, 13 of the housing portion 11 have rigid steel tubular portions 31, 32 affixed as by welding at the openings 27, 28 to the shell halves 12, 13, so as to guide the travel of the steel rams 29, 30. Each of the rams 29, 30 is flattened and tapered at 33 to define an elongate apex portion 34 for engaging and collapsing or crushing the casing 14 when the rams are moved inwardly against opposite sides of the casing 14.

Each of the rams 29, 30 also have a peripheral groove 35 therein which receives and carries an 0-ring which bears against and seals against the inner peripheral wall of the tubular portions 31, 32 to prevent or minimize escape of hydraulic fluid along the rams 29, 30.

A pair of power operated hydraulic cylinders, indicated in general by numeral 37, are mounted on the tubular portions 31, 32 of the shell halves 12, 13 of the housing portion 11 for driving the rams 29, 30.

Each of the hydraulic cylinders 37 has a piston 38 slidable in the cylinder chamber 39 to move the piston rod 40, the end portion of which is inserted into the mounting cavity 41 of the respective rams 29, 30, and secured therein by a removable steel connector pin 42.

The connector pins 42 which connect the piston rods 40 to the rams 29, 30 also extend outwardly through slots 43 in the sidewalls of the tubular portions 31, 32 as to prevent the rams 29, 30 from rotating away from their preset orientation wherein the elongate apex portions extend transversely of the elongate chamber portions 22, 23 and transversely of the casing 14.

The hydraulic cylinders 37 have mounting flanges 44 which are secured to the tubular portions 31, 32 of the housing portion by bolts 45 extending through flange portions 46 which are welded to the tubular portions 30, 31. Of course, the heads and nuts on the bolts 45 may be recessed into the flanges as desired.

Figure 2:
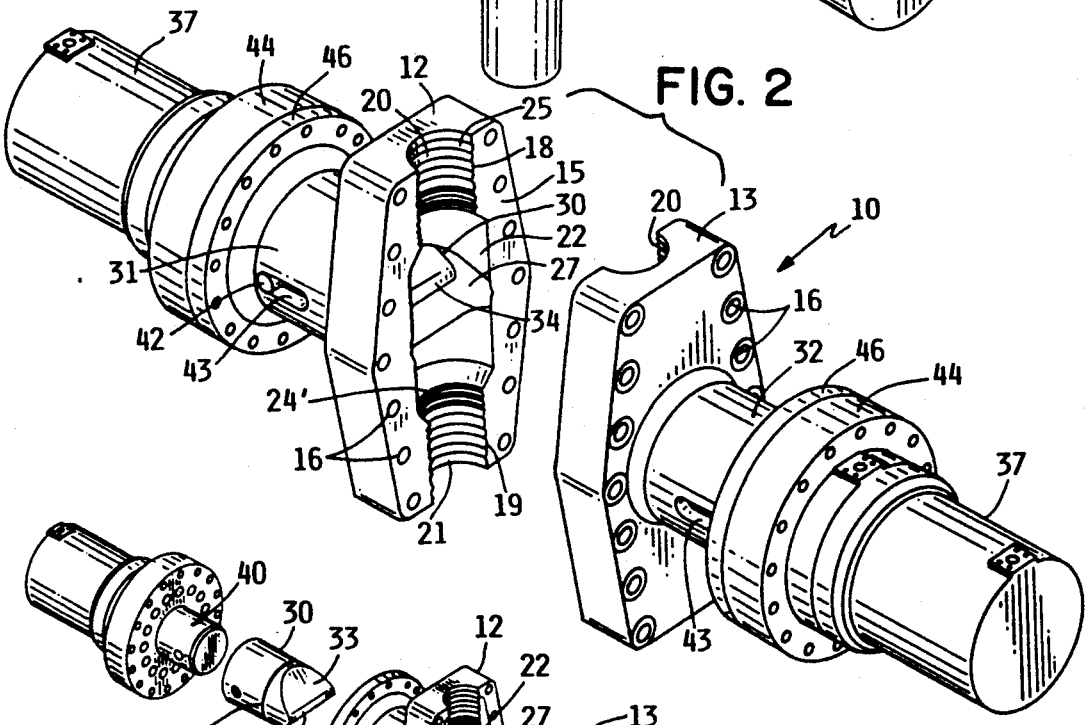
FIG. 2 is a perspective view of the apparatus prior to assembly with the heavy-duty well casing.
Figure 3:
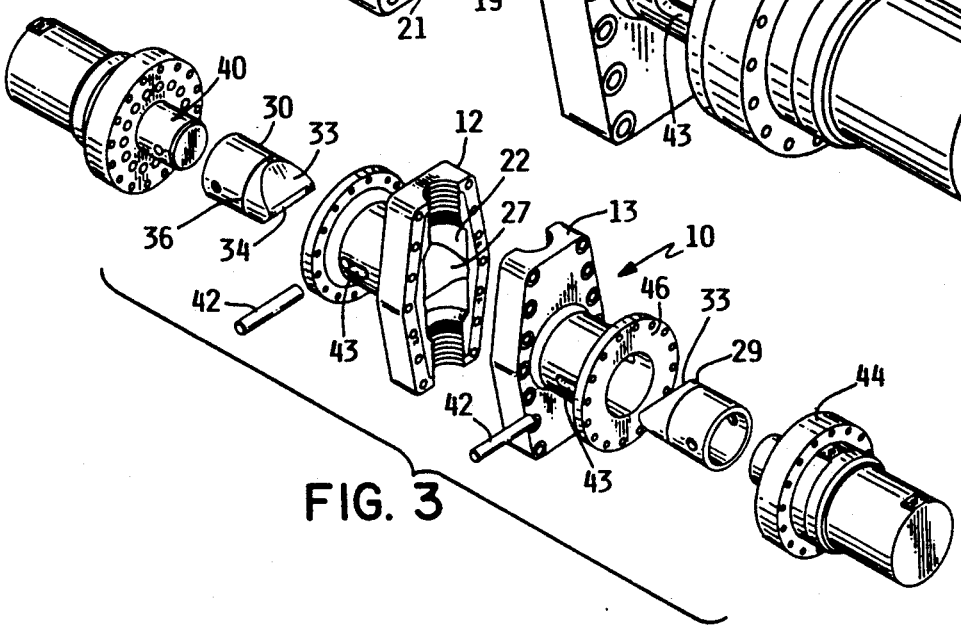
FIG. 3 is a diagrammatic and exploded view illustrating the several important assemblies of the apparatus.

Hydraulic fluid for operating the hydraulic cylinders 37 is supplied and evacuated through hose connections 47, 48 which supply hydraulic fluid from a suitable high pressure source controlled by suitable valving. The hydraulic hoses have fittings on their ends which adapt to the mounting pads 47.1, 48.1 on the corresponding portions of the hydraulic cylinders as illustrated in FIGS. 1 and 2.

In the use and operation of the casing and pipe collapsing and crushing apparatus, and particularly in the instance of a collapsing casing 14 in an oil well, the earth adjacent the well will be ditched or tunneled to obtain access to the well at a safe distance below ground level where oil may be spewing at a high rate and may be on fire. With gasket material in the grooves 25 at the opposite ends of the shell halves 12, 13, and with suitable gasket material lining the facing surfaces 15 of the shell halves, the shell halves will be assembled onto the casing 14, and bolts 17 are supplied into each of the bolt holes to draw the shell halves tightly against the outside surface of the casing 14. The facing surfaces 15 of the two shell halves will bear heavily against each other and will seal against each other. Simultaneously, the gasket material 26 in the grooves 25 at the upper and lower ends of the housing portion 11 will bear against the casing 14; and simultaneously, the sharp edged portions of the semicircular surfaces 20, 21, adjacent the grooves 24, will tightly grip and bite into the outer surface of the casing 14 as to very tightly grip the casing 14 and substantially seal against the casing.

Figure 5:
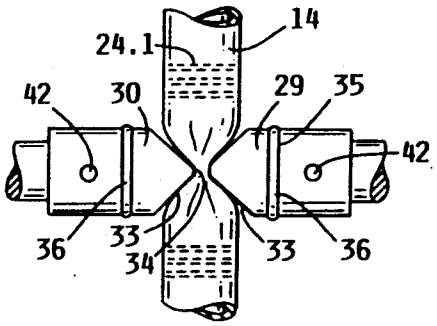
FIG. 5 is a diagrammatic view showing the collapsing of the heavy-duty casing.
Figure 6:
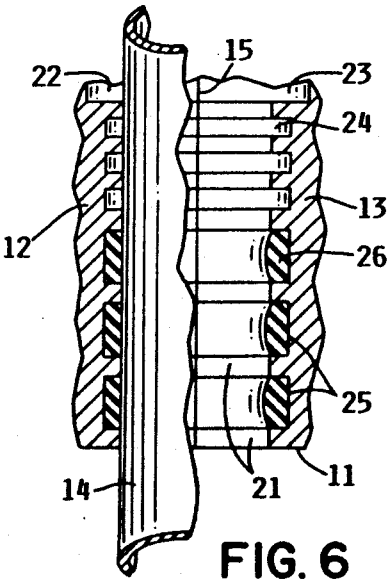
FIG. 6 is an enlarged detail section view illustrating the gripping and sealing of the attachment head to the heavy-duty pipe.

When the head portion 11 has been tightly clamped against the casing 14, hydraulic fluid is supplied to the hydraulic cylinders 37 and the rams 29, 30 are thereby pressed inwardly against the opposite sides of the casing 14 so as to move the rams 29, 30 into the dotted line positions illustrated in FIG. 4 and into the positions illustrated in FIG. 5. When the rams have been forceably moved against the casing 14, the casing will assume a collapsed or crushed position as illustrated in FIG. 5 and the flow of liquid or crude oil through the casing will be terminated, or nearly so. The steel in the casing 14 will in many cases rupture as the casing is being crushed or collapsed, and such ruptures may extend lengthwise along the casing 14. The grooved semicircular surfaces 20, 21 at the ends of the head portion 11, which very tightly grip the outer surface of the casing, prevent or minimize the elongation of ruptures in the casing, thereby nearly all of the ruptures and cracks are confined to the length of casing 14 which is between the gripping surfaces 20, 21 at opposite ends of the head portion 11. The gaskets or 0-rings 36 on the rams 29, 30 seal against the inner surfaces of tubular portions 31, 32 and prevent travel and spilling of liquid or crude oil along the length of the rams 29, 30.

In FIG. 5, the dotted lines indicated by numerals 24.1 illustrate the manner in which the upper and lower surfaces, 20, 21 of the head portions bite into and tightly grip the casing 14 and produce sealing and minimize any extension of the ruptures that will occur at the ram.

It will be seen that this invention provides a new and improved device for collapsing and crushing a heavy-duty steel casing or pipe through which liquids such as crude oil may be flowing as to terminate flow of the crude oil when no other control is available or operable. The apparatus tightly grips and seals off a length of the casing and hydraulically driven rams are moved inwardly against opposite sides of the casing to collapse and crush the casing, thereby closing off the flow of liquid through the casing. Leakage from the collapsed, crushed casing will likely occur in most cases, but the tight gripping of the casing by the head portion will minimize extension of the rupture; and seals about the periphery of the rams prevent leakage of the oil along the rams after they have been moved inwardly to collapse or crush the casing. The entire apparatus 10 is left in place on the casing while other procedures are performed as to subsequently provide flow control for the oil or liquid in the casing. For instance, in some instances, a hot tap will be provided into the casing below the apparatus 10 and concrete will be pumping into the casing to seal off the casing and to prevent any additional flow of oil upwardly through the casing. After flow of oil is stopped by concrete which has been allowed to set up, the apparatus 10 is removed and the upper portion of the casing is replaced and valving mechanisms are attached so that subsequently, the concrete can be drilled out so as to again have a controlled well.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

I claim:

1. An apparatus for collapsing rigid, metal heavy-duty casings and pipes, comprising:

an elongate two-part head portion embracing a casing to define an elongate closed chamber portion surrounding the outer surface of the casing and extending longitudinally along the length of the casing, said head portion having end portions at longitudinally opposite ends thereof and side portions which extend longitudinally and circumferentially along the length of the casing and between the opposite ends, said head portion also comprising longitudinally spaced clamping portions located at the opposite end portions and encircling the casing to clamp onto and tightly grip the casing to minimize liquid leakage from the chamber portion and along the casing, the two-part head portion being separable, a pair of casing collapsing rams, each ram enclosed within one part of the two-part head portion between said spaced clamping portions and within the opposite side portions, said rams being movable towards one another across portions of said closed elongate chamber portion, and said rams comprising spaced engaging portions to confront, engage and apply pressure onto opposite sides of the casing for collapsing and closing the casing sufficiently to close off flow of fluid through said casing, and hydraulic cylinder power portions affixed onto the head portion and driving each of the collapsing rams against the casing.

2. An apparatus according to claim 1 wherein the head portion comprises ram guiding openings encircling the rams, the casing collapsing rams comprising circular sealing portions sealing against the head portion in said openings and confining liquid against escaping along the rams.

3. An apparatus according to claim 1 wherein said head portion comprises a pair of elongate shell portions comprising facing surfaces bearing against and sealing against each other, the shell portions also comprising end portions defining said spaced clamping portions and having gripping and sealing faces bearing and sealing against the casing.

4. An apparatus according to claim 2 wherein the head portion comprises rigid transverse tubular portions defining said ram guiding openings and being oriented transversely of said elongate chamber portion and opening into said opposite sides of the chamber portion and confining said casing collapsing rams.

5. An apparatus according to claim 4 wherein said tubular portions mount said hydraulic cylinder power portions to the head portion.

6. An apparatus according to claim 1 wherein said engaging portions of the casing collapsing rams are flattened and tapered to an elongate apex portion oriented transversely of the elongate head portion and transversely of the casing extending through the head portion.

7. An apparatus according to claim 3 wherein said sealing faces comprise peripheral grooves and ribs between the grooves.

8. An apparatus according to claim 1 wherein the two-part head portion comprises a pair of elongate shell portions and a multiplicity of elongate connector bolts holding said shell portions together, the forces asserted by the hydraulic cylinder power portions being oriented in the direction of said bolts.

* * * * *